US012179982B2

(12) United States Patent
Merzeau et al.

(10) Patent No.: US 12,179,982 B2
(45) Date of Patent: Dec. 31, 2024

(54) ARTICLE CARRIER AND BLANK THEREFOR

(71) Applicant: WESTROCK PACKAGING SYSTEMS, LLC, Atlanta, GA (US)

(72) Inventors: Julien D. Merzeau, Châteauroux (FR); Fabrice Avril, Châteauroux (FR); Alexandre Therond, Châteauroux (FR); Nicolas Teillol, Diors (FR); Emmanuel Davaillon, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/914,585

(22) PCT Filed: Mar. 26, 2021

(86) PCT No.: PCT/US2021/024277
§ 371 (c)(1),
(2) Date: Sep. 26, 2022

(87) PCT Pub. No.: WO2021/195454
PCT Pub. Date: Sep. 30, 2021

(65) Prior Publication Data

US 2023/0192377 A1 Jun. 22, 2023

Related U.S. Application Data

(60) Provisional application No. 63/062,989, filed on Aug. 7, 2020, provisional application No. 63/000,158, filed on Mar. 26, 2020.

(51) Int. Cl.
*B65D 71/42* (2006.01)

(52) U.S. Cl.
CPC ..... *B65D 71/42* (2013.01); *B65D 2571/0016* (2013.01); *B65D 2571/0029* (2013.01);
(Continued)

(58) Field of Classification Search
CPC ..... B65D 71/40; B65D 71/42; B65D 71/46; B65D 2571/0016; B65D 2571/0029; B65D 2571/00444; B65D 2571/0066
(Continued)

(56) References Cited

U.S. PATENT DOCUMENTS 3,114,493 A 12/1963 Dunkin
4,403,689 A * 9/1983 Wood ..... B65D 71/125 206/427
(Continued)

FOREIGN PATENT DOCUMENTS

EP 0240126 A2 10/1987
EP 2067713 A1 6/2009
(Continued)

OTHER PUBLICATIONS

International Search Report issued in corresponding PCT Patent Application No. PCT/US2021/024277 on Jul. 15, 2021.

*Primary Examiner* — Bryon P Gehman
(74) *Attorney, Agent, or Firm* — Brian J. Goldberg; Rohini K. Garg

(57) ABSTRACT

An article carrier for packaging one or more articles and a blank for forming the carrier are disclosed. The carrier (90) comprises an engaging panel (12) having at least one article-engaging structure (RT1, RT2). The carrier (90) comprises a bundling structure having first and second segments. The first segment includes a first panel (14) hinged to the engaging panel (12) and abridging portion (22A, 26A) hinged to the first panel (14). The second segment includes a second panel (18A) hinged to the engaging panel (12), a third panel (18B) hinged to the second panel (18A) in overlapping position therewith and a bridge-engaging feature engaging the bridging portion (22A, 26A). The bridge-engaging feature is provided at least by the second and third
(Continued)

panels (18A, 18B) such that art of the bridging portion (22A, 26A) is disposed between the second and third panels (18A, 18B).

20 Claims, 10 Drawing Sheets

(52) U.S. Cl.
CPC ..... *B65D 2571/00444* (2013.01); *B65D 2571/0066* (2013.01)

(58) Field of Classification Search
USPC ..... 206/140
See application file for complete search history.

(56) References Cited

U.S. PATENT DOCUMENTS

| | | | |
|---|---|---|---|
| 4,423,810 | A | 1/1984 | Bader |
| 5,186,321 | A | 2/1993 | Fadus |
| 6,899,266 | B2 | 5/2005 | Conway |
| 7,635,080 | B2 | 12/2009 | Conway |

FOREIGN PATENT DOCUMENTS

| | | | | | |
|---|---|---|---|---|---|
| FR | 1452743 | A | | 4/1966 | |
| GB | 2280884 | A | * | 2/1995 | ..... B65D 71/42 |
| JP | 5586510 | B2 | | 9/2014 | |
| JP | 2016005964 | A | | 1/2016 | |

* cited by examiner

ARTICLE CARRIER AND BLANK THEREFOR

TECHNICAL FIELD

The present invention relates to article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides an article carrier for engaging at least one article. The article carrier comprises an engaging panel which has at least one article-engaging structure for engaging a part of the at least one article. The article carrier comprises a bundling structure for encircling the at least one article. The bundling structure comprises a first segment and a second segment. The first segment includes a first panel hingedly connected to the engaging panel and a bridging portion hingedly connected to the first panel. The second segment includes a second panel hingedly connected to the engaging panel and a third panel hingedly connected to the second panel and disposed in an overlapping position with the second panel. The second segment also includes a bridge-engaging feature in engagement with the bridging portion of the first segment. The bridge-engaging feature is provided at least by the second and third panels such that at least part of the bridging portion is disposed between the second and third panels in face-contacting arrangement with the second and third panels.

Optionally, the bridge-engaging feature comprises a first cutaway defined in at least one of the second and third panels, the first cutaway providing a first receiver for a first portion of the bridging portion.

Optionally, the bridge-engaging feature comprises a second cutaway in at least one of the engaging panel and the second panel, the second cutaway providing a second receiver for a second portion of the bridging portion.

Optionally, the second cutaway extends from one of said at least one article-engaging structures.

Optionally, the bridging portion comprises at least one detent, optionally, a pair of detents.

Optionally, the article carrier is preformed prior to application to a group of articles.

Optionally, the bridge-engaging feature comprises at least one locking element provided by the second panel and at least one locking opening defined in the bridging portion and receiving the locking element.

Optionally, the bridge-engaging feature may further comprise a second cutaway in one of the bridging portion and second panel, the second cutaway providing a second receiver for a tab provided by the other one of the bridging portion and second panel.

A second aspect of the invention provides an article carrier for engaging at least one article. The article carrier comprises an engaging panel which has at least one article-engaging structure for engaging a part of the at least one article and a bundling structure for encircling the at least one article. The bundling structure comprises a first segment, a second segment, and a bridge-engaging feature. The first segment includes a first panel hingedly connected to the engaging panel and a bridging portion hingedly connected to the first panel. The second segment includes a second panel hingedly connected to the engaging panel. The bridge-engaging feature is provided by at least part of the at least one article-engaging structure. The bridge-engaging feature is engaged with the bridging portion of the first segment such that the first panel and second panel are interconnected continuously by the bridging portion extending between the first and second segments.

Optionally, the article carrier comprises a handle opening defined, at least in part, in one of the panels forming the first or second segment.

Optionally, the handle opening is defined in part in the engaging panel.

Optionally, the article carrier comprises a handle opening defined, at least in part, in the engaging panel.

A third aspect of the invention provides a blank for forming an article carrier. The blank comprises an engaging panel which has at least one article-engaging structure for engaging a part of the at least one article. The blank comprises a bundling structure for encircling the at least one article. The bundling structure comprises a first segment and a second segment. The first segment includes a first panel hingedly connected to the engaging panel and a bridging portion hingedly connected to the first panel. The second segment includes a second panel hingedly connected to the engaging panel and a third panel hingedly connected to the second panel and disposed in an overlapping position with the second panel. The second segment also includes a bridge-engaging feature for engagement with the bridging portion of the first segment. The bridge-engaging feature is provided at least by the second and third panels and arranged such that in a setup carrier at least part of the bridging portion is disposed between the second and third panels in face-contacting arrangement with the second and third panels.

A fourth aspect of the invention provides a blank for forming an article carrier. The blank comprises an engaging panel which has at least one article-engaging structure for engaging a part of the at least one article and a bundling structure for encircling the at least one article. The bundling structure comprises a first segment, a second segment, and a bridge-engaging feature. The first segment includes a first panel hingedly connected to the engaging panel and a bridging portion hingedly connected to the first panel. The second segment includes a second panel hingedly connected to the engaging panel. The bridge-engaging feature is provided by at least part of the at least one article-engaging structure. The bridge-engaging feature isengageable with the bridging portion of the first segment in a setup carrier such that the first panel and second panel are interconnected continuously by the bridging portion extending between the first and second segments.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
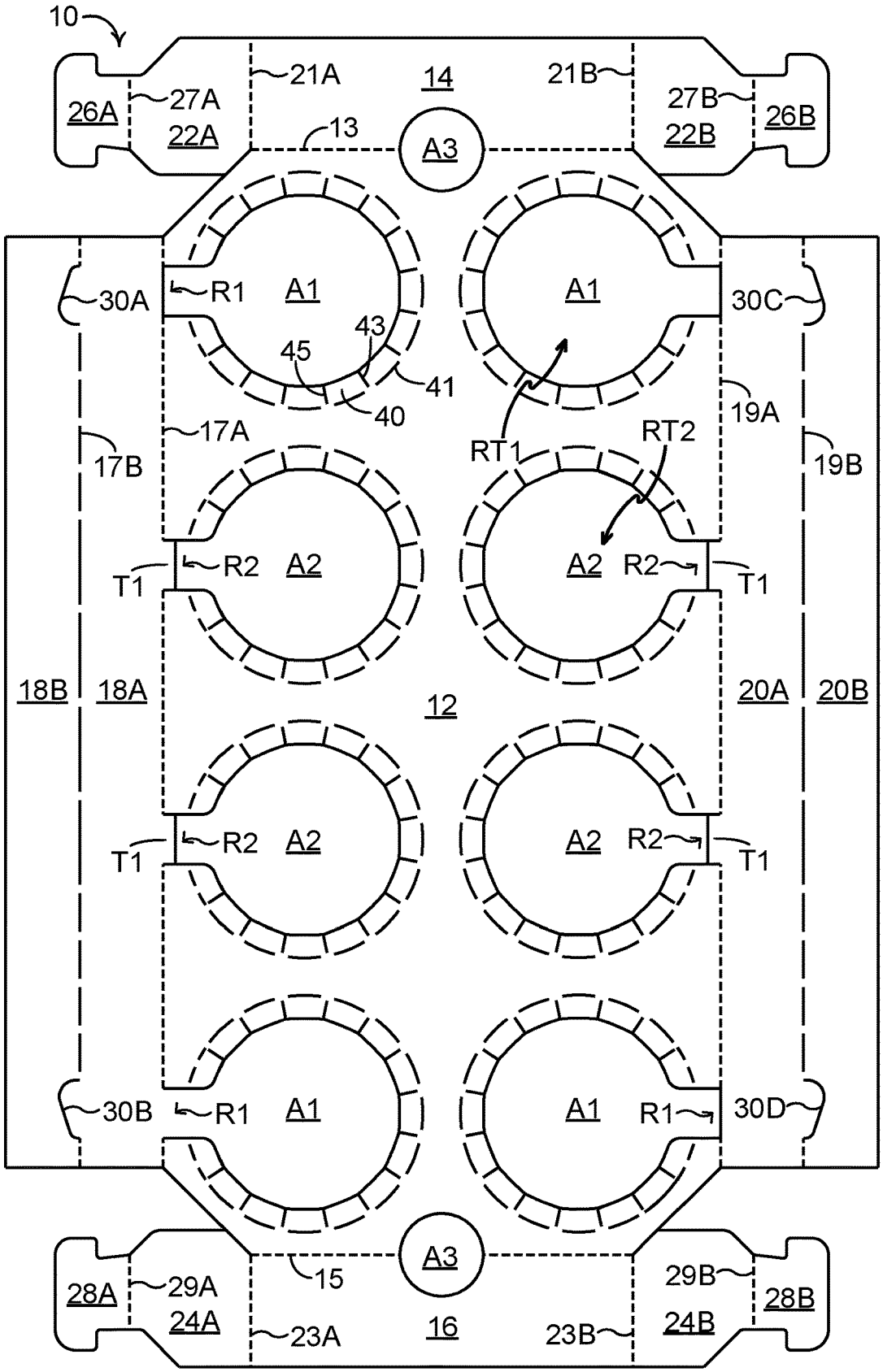
FIG. 1 is a plan view from above of a blank for forming a carrier according to a first embodiment.
Figure 2:
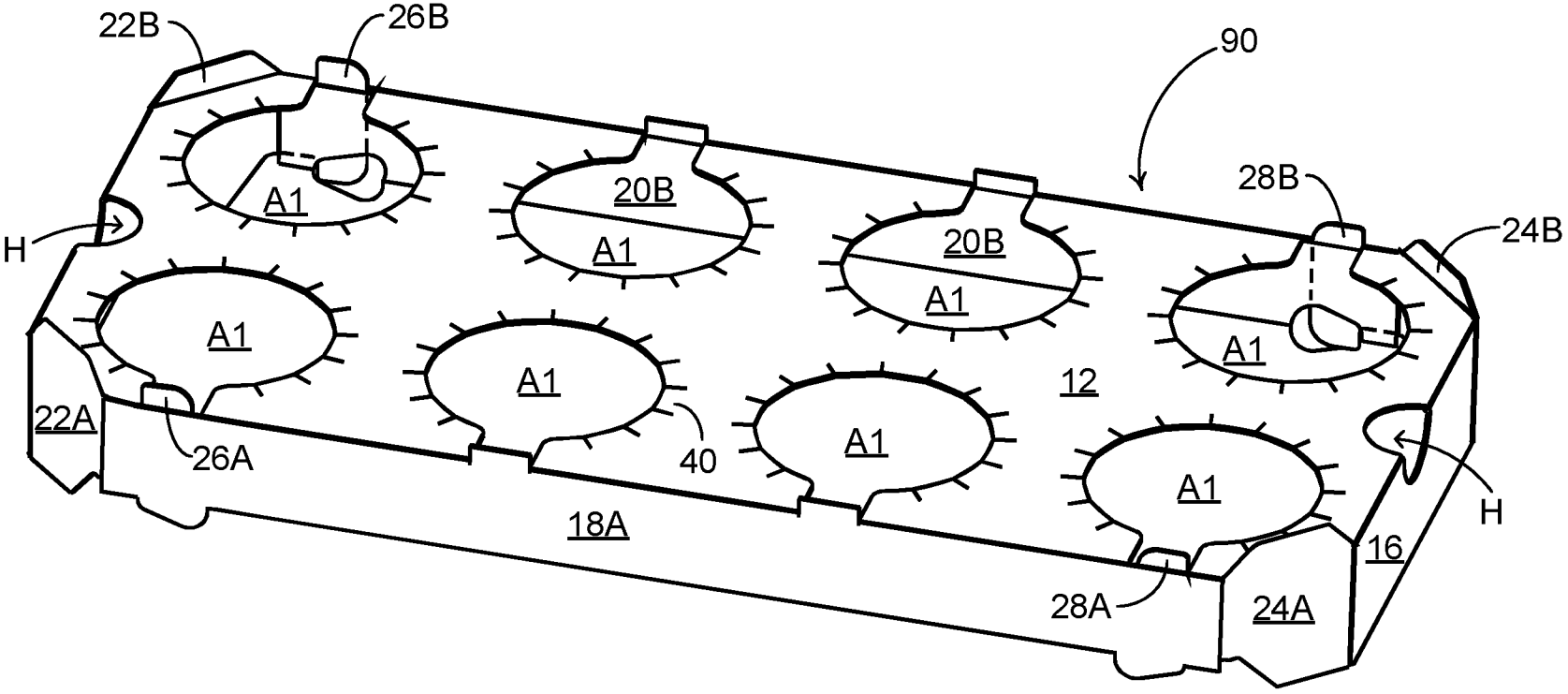
FIG. 2 is a perspective view from above of a carrier formed from the blank of FIG. 1.
Figure 3:
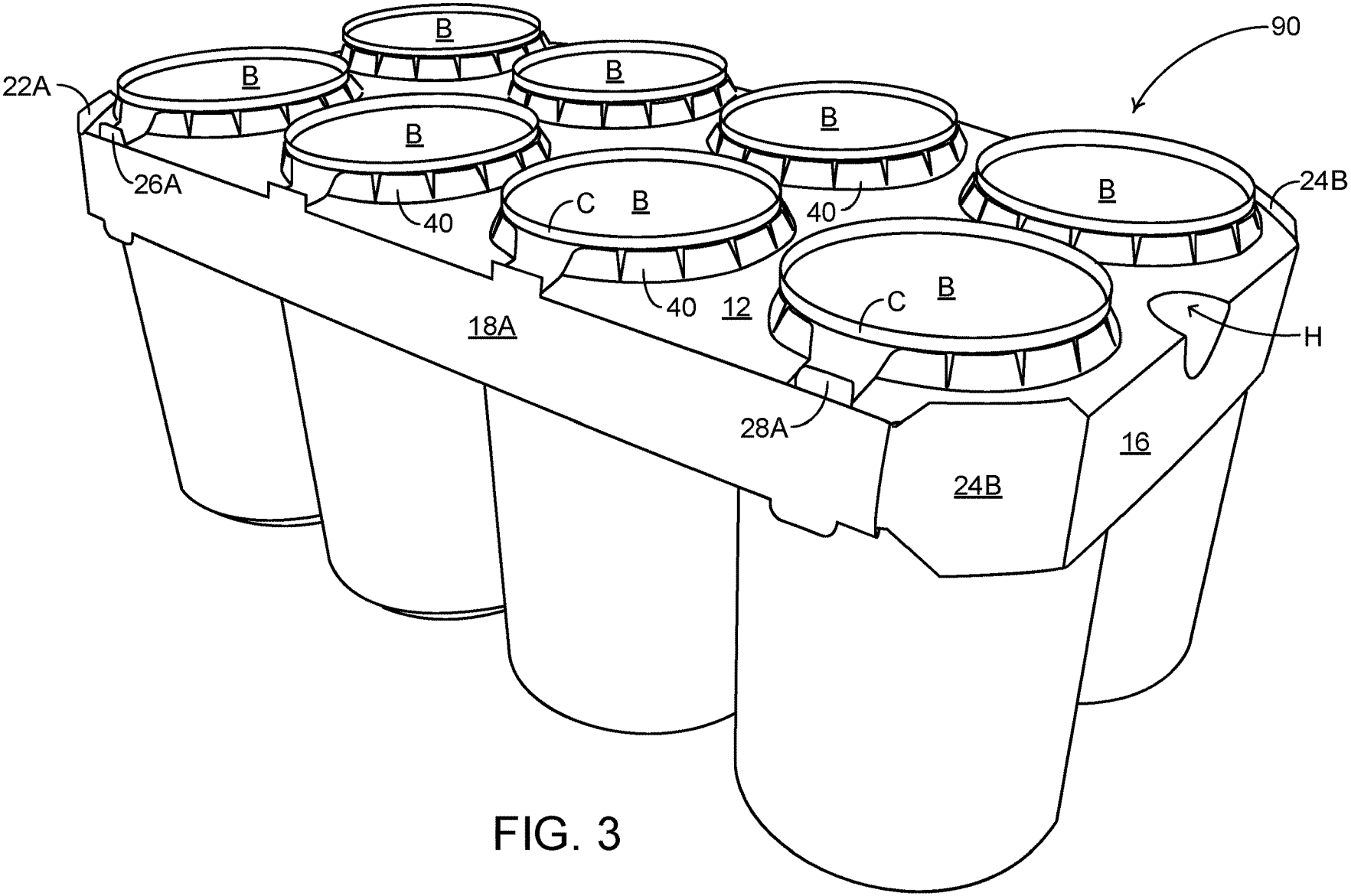
FIG. 3 is a plan view from above of a blank for forming a carrier according to a second embodiment.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B, as shown in FIG. 3. The blank 10 forms a secondary package for packaging at least one primary product container or package.

Figure 5:
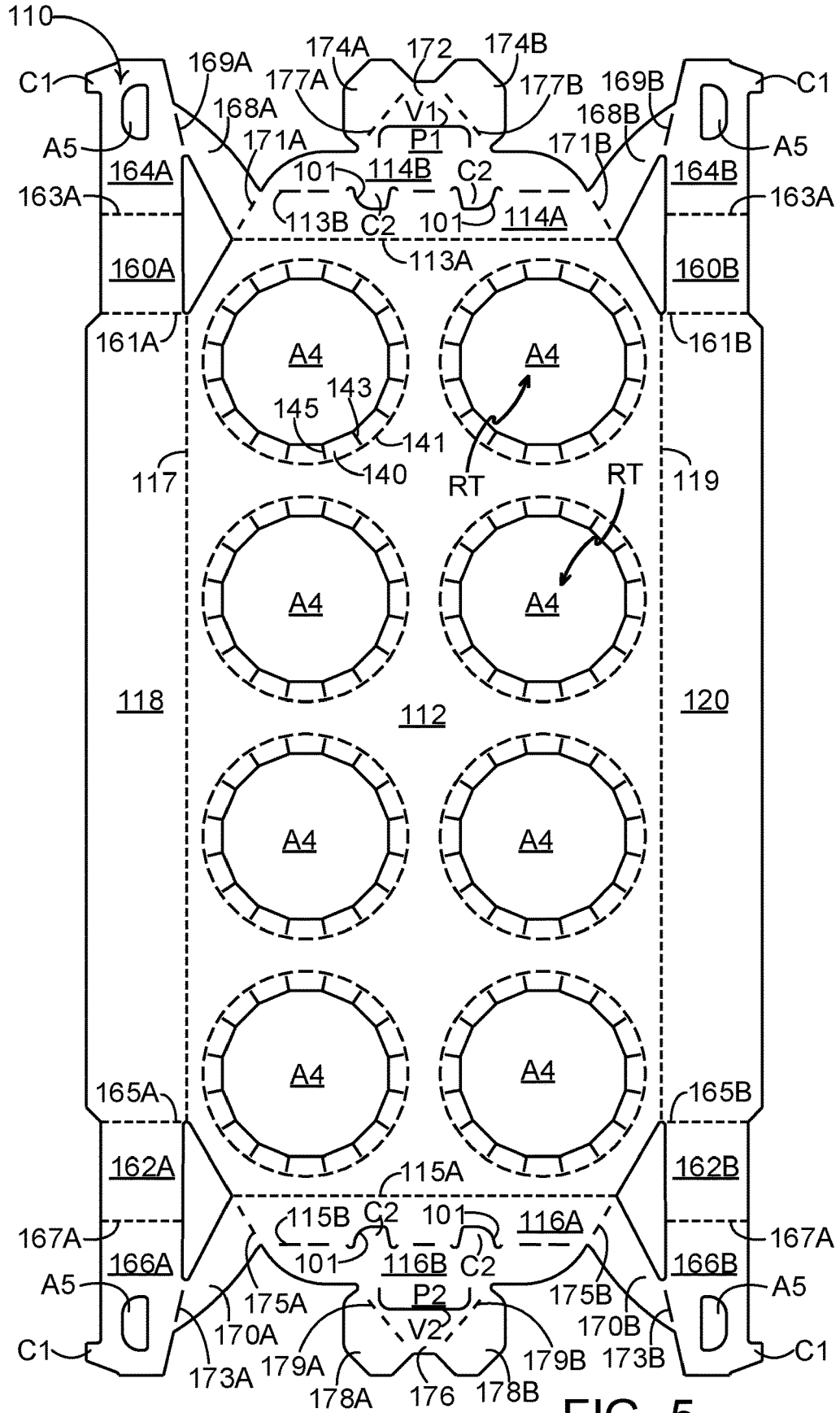
FIG. 5 is a plan view from above of a blank for forming a carrier according to a second embodiment.
Figure 6:
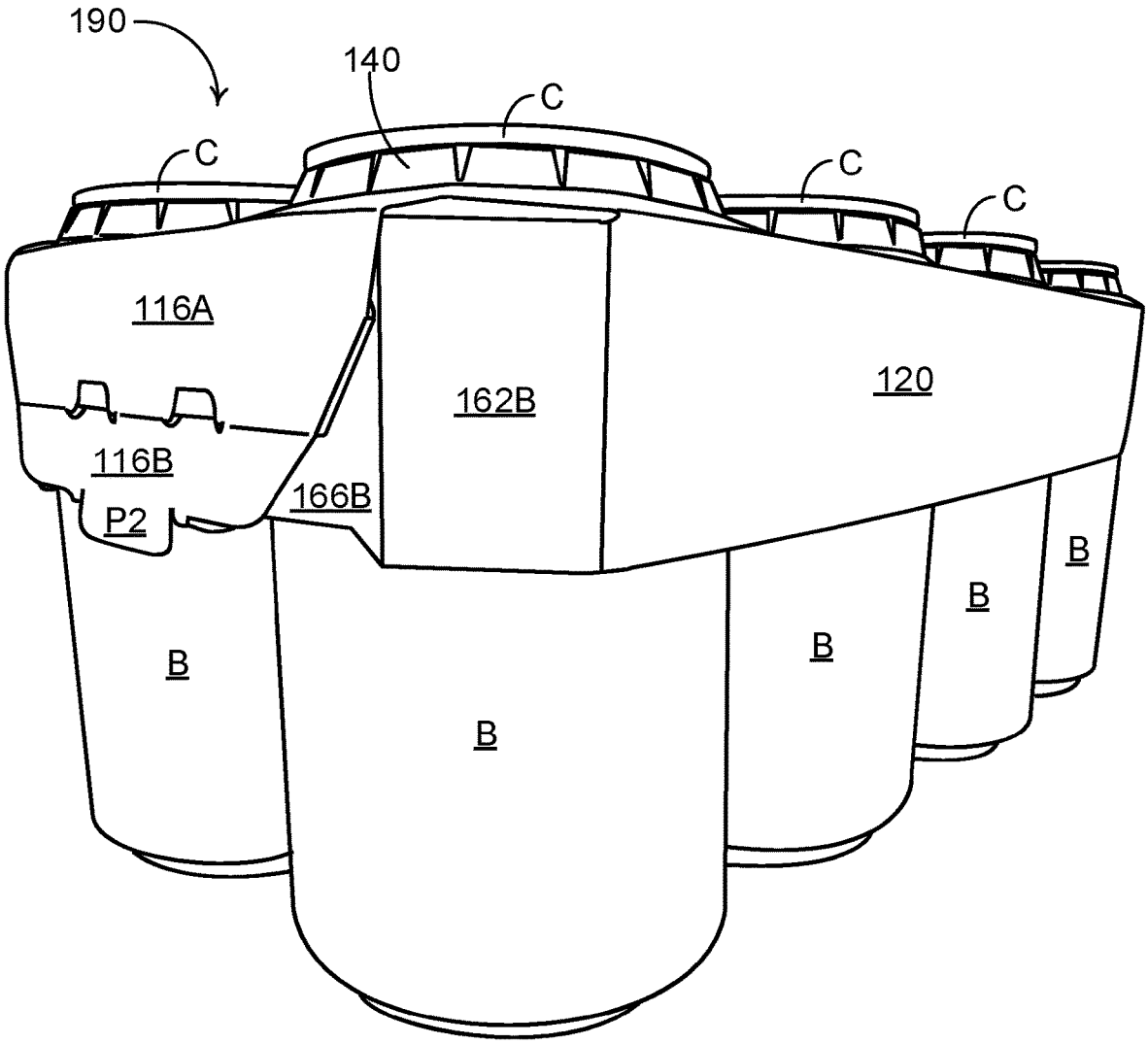
FIG. 6 is a perspective view from above of a carrier formed from the blank of FIG. 5.
Figure 10:
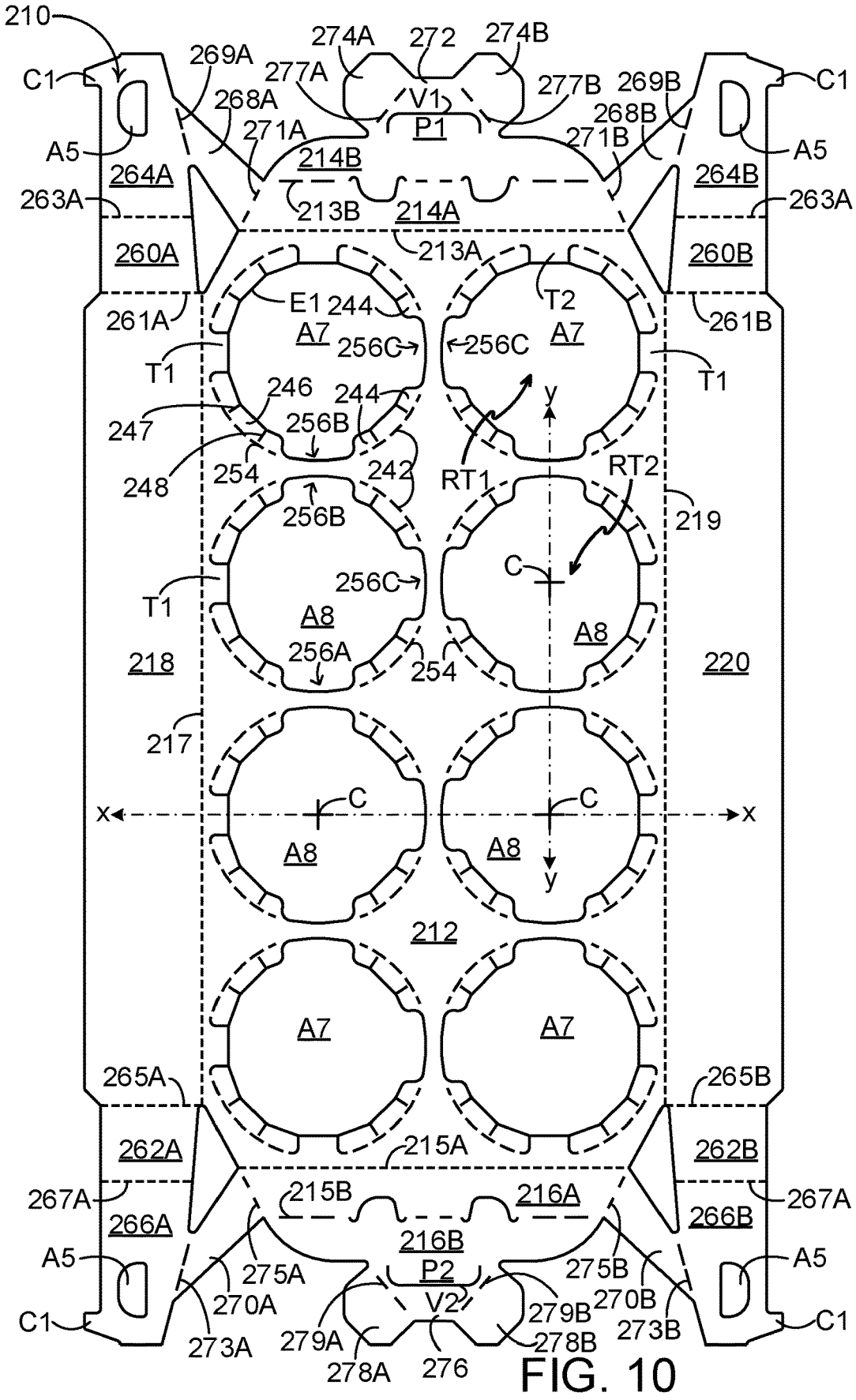
FIG. 10 is a plan view from above of a blank for forming a carrier according to a third embodiment.

Alternative blanks 110; 210 are shown in FIGS. 5 and 10 for forming carton or carrier 190, as shown in FIG. 6, for containing and carrying a group of primary products such as, but not limited to, bottles or cans, hereinafter referred to as articles B.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminum cans), tins, pouches, packets and the like.

The blank 10; 110; 210 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons 90; 190 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210 are configured to form a carton or carrier 90 for packaging an exemplary arrangement of exemplary articles B. In the embodiment illustrated in FIGS. 1 to 9, the arrangement is a 2×4 matrix or array; in the illustrated embodiments two rows of four articles B are provided, and the articles B are 330 ml beverage cans. In the embodiment illustrated in FIG. 10, the arrangement is a 2×4 matrix or array; in the illustrated embodiments two rows of four articles B are provided, and the articles B are 330 ml beverage cans of a sleek or slim design.

Alternatively, the blanks 10; 110; 210 can be configured to form a carrier for packaging other types, number and size of articles and/or for packaging articles in a different arrangement or configuration.

Referring to FIG. 1 there is shown a blank 10 comprising a plurality of panels 12, 14, 16, 18A, 18A, 20A, 20B, including a main panel 12 for forming a top wall or engaging panel of a carrier 90 (see FIG. 2).

A first outer side panel 18A is hingedly connected to a first side of the main panel 12 by a hinged connection in the form of a fold line 17A. A first inner side panel 18B is hingedly connected to the first outer side panel 18A by a hinged connection in the form of a fold line 17B.

A second outer side panel 20A is hingedly connected to a second side of the main panel 12 by a hinged connection in the form of a fold line 19A. A second inner side panel 20B is hingedly connected to the second outer side panel 20A by a hinged connection in the form of a fold line 19B.

The blank 10 comprises a first end strap 26A/22A/14/22B/26B. The first end strap 26A/22A/14/22B/26B comprises a first end panel 14. The first end panel 14 is hingedly connected to a first end of the main panel 12 by a hinged connection in the form of a fold line 13. A first corner panel 22A is hingedly connected to a first end of the first end panel 14 by a hinged connection in the form of a fold line 21A. A first securing panel 26A is hingedly connected to an end of the first corner panel 22A by a hinged connection in the form of a fold line 27A.

A second corner panel 22B is hingedly connected to a second end of the first end panel 14 by a hinged connection in the form of a fold line 21B. A second securing panel 26B is hingedly connected to an end of the second corner panel 22B by a hinged connection in the form of a fold line 27B.

The first end strap 26A/22A/14/22B/26B forms a first end wall of the carrier 90.

The blank comprises a second end strap 28A/24A/16/24B/28B. The second end strap 28A/24A/16/24B/28B comprises a second end panel 16. The second end panel 16 is hingedly connected to a second end of the main panel 12 by a hinged connection in the form of a fold line 15. A third corner panel 24A is hingedly connected to a first end of the second end panel 16 by a hinged connection in the form of a fold line 23A. A third securing panel 28A is hingedly connected to an end of the third corner panel 24A by a hinged connection in the form of a fold line 29A.

A fourth corner panel 24B is hingedly connected to a second end of the second end panel 16 by a hinged connection in the form of a fold line 23B. A fourth securing panel 28B is hingedly connected to an end of the fourth corner panel 24B by a hinged connection in the form of a fold line 29B.

The second end strap 28A/24A/16/24B/28B forms a second end wall of the carrier 90.

The first end strap 26A/22A/14/22B/26B, second end strap 28A/24A/16/24B/28B inner and outer side panels 18B, 20B, 18A, 20A form part of a bundling structure for surrounding the articles B being packaged.

The main panel 12 of the blank 10 includes at least one article retention structure RT1, RT2. The main panel 12 comprises a plurality of article retention structures RT1, RT2, specifically eight article retention structures RT1, RT2 arranged in 2×4 matrix or array. Each of the article retention structures RT1, RT2 comprises an opening or aperture A1, A2.

The article retention structures RT1, RT2 of the illustrated embodiment take the form of a plurality of teeth or tabs 40 arranged in an annular series about an aperture A1, A2 to form part of an article receiving opening. In other embodiments the article retention structures RT1, RT2 may take a different form, for example but not limited to a pair of spaced apart opposing cuts which define a displaceable region forming a cover over an article and providing a pair of opposed engaging edges for engaging opposing sides of an article below a flange, chime or other projection.

The blank 10 comprises four endmost article retention structures RT1 each comprising a first opening or aperture A1. The blank 10 comprises four medial or intermediate article retention structures RT2 each comprising a second opening or aperture A2.

The endmost article retention structures RT1 comprises an article receiving opening defined in part by the first aperture A1 which is defined in, or struck from, the main panel 12.

The intermediate article retention structures RT2 comprises an article receiving opening defined in part by the second aperture A2 which is defined in, or struck from, the main panel 12.

The endmost article retention structures RT1 and the intermediate article retention structures RT2 each comprise a plurality of teeth or tabs 40 disposed about the first or second aperture A1, A2 respectively.

The plurality of teeth 40 are provided by the main panel 12. Each of the teeth 40 is hingedly connected to the main panel 12, by a hinged connection. The hinged connection may be defined by a plurality of cut lines 41. The plurality of cut lines 41 may be arranged as an annular series of cuts about the first or second apertures A1, A2.

The plurality of cut lines 41 may define or approximate a portion of circle.

Each of the plurality of teeth 40 comprises an engaging edge opposing a hinged edge. The engaging edges are defined by a linear portion of a cut line defining the first or second aperture A1, A2. Each engaging edge may define a part of a polygon. The illustrated embodiment comprises fifteen teeth 40 together defining a substantial portion of a hexadecagon. Each tooth 40 comprises a pair of side edges, the side edges are defined by cut lines 43, 45 extending radially outward from respective vertices of the hexadecagon, that is to say, from a respective vertex between a pair of adjacent linear portions of the cut line defining the portion of a hexadecagon. The cut lines 43, 45 are divergently arranged with respect to each other and define an angle therebetween, the angle may be about 22.5°.

Each of the plurality of cut lines 41 may be linear in shape.

In alternative embodiments each of the plurality of cut lines 41 may be arcuate or curved. The cut lines 41 may comprise a radius of curvature which is equal to half the diameter of the article receiving openings. The cut lines 41 may comprise a radius of curvature which is greater than half the diameter of article receiving openings.

The plurality of teeth 40 is interrupted by at least one recess or cutaway R1, R2.

The plurality of teeth 40 of the endmost article retention structures RT1 are interrupted by a first recess or cutaway R1. The first recess R1 is provided at a location about the circumference of the first aperture A1 disposed in closest proximity to one of the side edges, defined by the fold lines 17A, 19A, of the main panel 12. The first recess R1 extends from the first aperture A1 to the first or second outer side panel 18A, 20A. The first recess R1 may interrupt or intersect with the fold line 17A, 19A between the main panel 12 and the first or second outer side panel 18A, 20A.

The plurality of teeth 40 of the intermediate article retention structures RT2 are interrupted by a second recess or cutaway R2. The second recess R2 is provided at a location about the circumference of the second aperture A2 disposed in closest proximity to one of the side edges, defined by the fold lines 17A, 19A, of the main panel 12. The second recess R2 extends from the first aperture A1 towards the first or second outer side panel 18A, 20A. The second recess R2 may terminate within the main panel 12 and define a spaced apart relationship with the fold line 17A, 19A between the main panel 12 and the first or second outer side panel 18A, 20A. A tab T1 may be provided by material which would otherwise form the main panel 12. The tab T1 is integral with the first or second outer side panel 18A, 20A, that is to say they have an uninterrupted connection thereto—no fold or other hinge defining device is provided between the tab T1 and the first or second outer side panel 18A, 20A.

The second recesses R2 are shorter in length in a transverse direction of the blank 10 than the first recesses, when in the unfolded blank 10.

The main panel 12 may optionally comprise a handle structure H see FIG. 2. The handle structure may comprise at least one handle opening A3. In the illustrated embodiment the blank 10 comprises two handle openings A3. A first one of the handle openings A3 is struck in part from the main panel 12 and in part from the first end panel 14. A second one of the handle openings A3 is struck in part from the main panel 12 and in part from the second end panel 16.

The securing panels 26A, 26B, 28A, 28B are arranged to interlock with the side panels 18A/18B, 20A/20B.

The securing panels 26A, 26B, 28A, 28B are substantially "T" or hammerhead shaped although in other embodiments other suitable shapes may be employed to provide a detent or catch. The securing panels 26A, 26B, 28A, 28B comprises a pair of shoulders defined by substantially "L" shaped edge portions. The shoulders provide a catch or detent preventing or inhibiting separation of the securing panels 26A, 26B, 28A, 28B from a receiver provided in part by the side panels 18A, 18B, 20A, 20B and the first recesses R1 in the main panel 12.

The first outer and first inner side panels 18A, 18B comprise a pair of cutaways, in the illustrated embodiment the cutaways take the form of a cut line 30A, 30B. The cut lines 30A, 30B are nonlinear and interrupt the fold line 17B hinging the first outer side panel 18A to the first inner side panel 18B. When the first inner panel 18B is folded about fold line 17B to be in face to face relationship with the first outer panel 18A lower receiver openings are formed therebetween, proximate the hinged connection. The second outer and first inner side panels 20A, 20B comprise a pair of cutaways, in the illustrated embodiment the cutaways take the form of a cut line 30C, 30D. The cut lines 30C, 30D are nonlinear and interrupt the fold line 19B hinging the second outer side panel 20A to the second inner side panel 20B. When the second inner panel 20B is folded about fold line 19B to be in face to face relationship with the second outer panel 20A lower receiver openings are formed therebetween, proximate the hinged connection, best illustrated in FIG. 2. The first recesses R1 form upper receiver openings and together with the lower receiver openings provide a receiver for engaging with and locking the first and third securing panels 26A, 28A to the first outer and first inner side panels 18A, 18B and locking the second and fourth securing panels 26B, 28B to the second outer and second inner side panels 20A, 20B.

Turning to the construction of the carrier 90 from the blank 10, the blank 10 may be formed into an assembled carrier 90, as shown in FIG. 2, prior to being applied to a group of articles B.

The blank 10 is folded about fold lines 13, 15 to bring the first end panel 14 into substantially perpendicular relationship with the main panel 12 and second end panel 16 into substantially perpendicular relationship with the main panel 12.

The blank 10 is folded about fold line 21A to fold the first corner panel 22A about an adjacent corner of the main panel 12. The blank 10 is folded about fold line 21B to fold the second corner panel 22B about an adjacent corner of the main panel 12. The blank 10 is folded about fold line 22B to fold the third corner panel 24A about an adjacent corner of the main panel 12. The blank 10 is folded about fold line 24B to fold the fourth corner panel 24B about an adjacent corner of the main panel 12.

The first securing panel 26A is folded with respect to the first corner panel 22A about fold line 27A, the first securing panel 26A is folded so as to be substantially perpendicular to the first end panel 14.

The second securing panel 26B is folded with respect to the second corner panel 22B about fold line 27B, the second securing panel 26B is folded so as to be substantially perpendicular to the first end panel 14.

The third securing panel 28A is folded with respect to the third corner panel 24A about fold line 29A, the third securing panel 28A is folded so as to be substantially perpendicular to the second end panel 16.

The fourth securing panel 28B is folded with respect to the fourth corner panel 24B about fold line 29B, the fourth securing panel 28B is folded so as to be substantially perpendicular to the second end panel 19.

Upper portions of the securing panels 26A, 26B, 28A, 28B may be inserted or engaged in the upper receiver openings provided by the first recesses R1.

The blank 10 is folded about fold line 17B to bring the first inner side panel 18B into face to face relationship with the first outer side panel 18A. In doing so the first and third securing panels 26A, 28A are disposed or sandwiched between the first inner and first outer side panels 18B, 18A.

The blank 10 is folded about fold line 19B to bring the second inner side panel 20B into face to face relationship with the second outer side panel 20A. The second and fourth securing panels 26B, 28B are disposed or sandwiched between the second inner and second outer side panels 20B, 20A.

Lower portions of the securing panels 26A, 26B, 28A, 28B are received in the lower receiver openings provided by the cutaways 30A, 30B, 30C, 30D.

A first portion of each securing panel 26A, 26B, 28A, 28B passes through a respective one of the lower receiver openings. A second portion of each securing panel 26A, 26B, 28A, 28B passes through a respective one of the upper receiver openings. In this way the first end strap 26A/22A/14/22B/26B and the second end strap 28A/24A/16/24B/28B are locked in position. Advantageously, the carrier 90 may be assembled or constructed without use of glue or adhesive to secure the panels 12, 14, 16, 18A, 18A, 20A, 20B in an erected condition.

The assembled or preformed carrier 90 is then applied to a group of articles B. The carrier 90 is lowered with respect to a group of articles B. Each of the article retention structures RT1, RT2 of the blank 10 is aligned with a respective article B in the group. Portions of the articles B pass through the main panel 12. The toothed regions of the main panel 12 about each of the article retention structures RT1, RT2 may be folded out of the plane of the main panel 12.

Each toothed region of the main panel 12 may be folded about one of the articles B received in the respective one of the article retention structures RT1, RT2. Themain panel 12 may deform about the article B for example but not limited to a shoulder portion of the article B, where the article B is a can the shoulder portion may be provide by the neck-in, as shown in FIG. 3.

Figure 4:
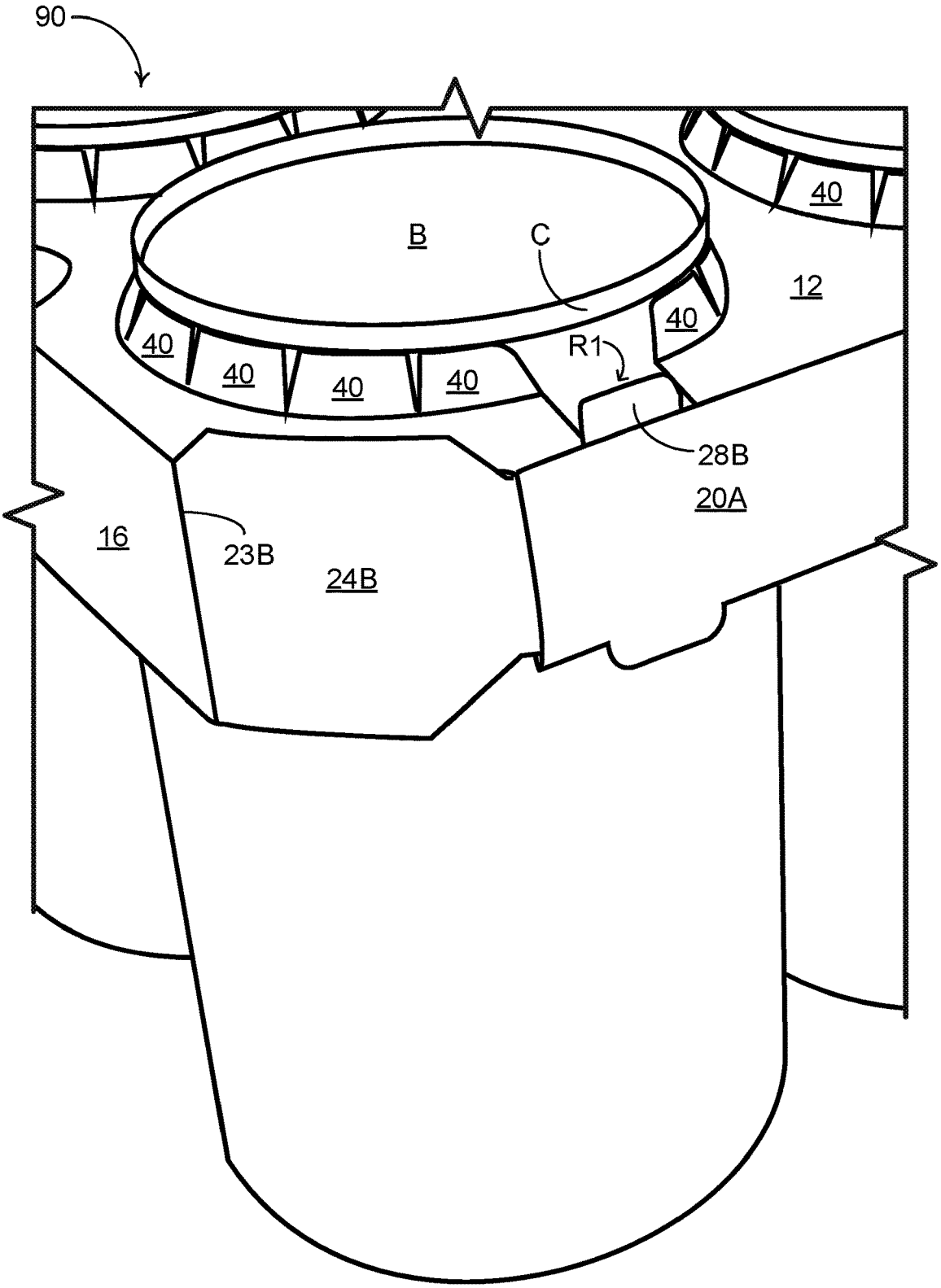
FIG. 4 is a perspective view from above of a carrier formed from the blank of FIG. 3.

The engaging edges of the teeth 40 engage beneath a projection. The projection may be located about the neck or chime of the article B (which may provide a flange) of an article B. When the article B is a can the projection may be provided by a canner's end seam. In other embodiments it may be provided by a ridge or undercut shaping of the article B or by an end closure of the article B for example but not limited to a crown cork or closure. In this way, the engaging edges grip or hold the article B and prevent or inhibit the article B from unintentionally separating from the main panel 12. A package comprising the article carrier 90 and the group of article B is shown in 90 is shown in FIGS. 3 and 4.

The carrier 90 may beneficially conceal a part of the articles B from view. The side panels 18A, 18A, 20A, 20B and/or end panels 14, 16 may conceal a region of the articles B, for example the said panels 18A, 18A, 20A, 20B, 14, 16 may conceal a barcode or other indicia such as but not limited to price indicia provided on individual articles B.

The side panels 18A, 18A, 20A, 20B and end panels 14, 16 encircle or surround the group of articles B and may contain or confine the articles B; they may prevent or inhibit movement of the articles B for example tilting or splaying of the articles B when the article carrier 90 is carried by a user. The engagement of the side panels 18A, 18A, 20A, 20B with the end panels 14, 16 via the securing panels 26A, 26B, 28A, 28B (and the corner panels 22A, 22B, 24A, 24B when present) may increase the strength, rigidity and robustness of the carrier 90 for example when carrying the carrier 90 by engagement with one of the plurality of panels 12, 14, 16, 18A, 18A, 20A, 20B.

Referring now to FIG. 5 there is shown an alternative embodiment of the present disclosure. In the second illustrated embodiment, like numerals have, where possible, been used to denote like parts, albeit with the addition of the prefix "100" to indicate that these features belong to the second embodiment. The alternative embodiment shares many common features with the embodiment of FIGS. 1 to 4, therefore only the differences from the embodiment illustrated in FIGS. 1 to 4 will be described in any greater detail.

FIG. 5 shows a blank 110 comprising a plurality of panels 112, 114A, 114B, 116A, 116B, 118, 120, including a main panel 112 for forming a top wall or engaging panel of a carrier 190 (see FIG. 6).

A first side panel 118 is hingedly connected to a first side of the main panel 112 by a hinged connection in the form of a fold line 117.

A second side panel 120 is hingedly connected to a second side of the main panel 112 by a hinged connection in the form of a fold line 119.

The blank 110 comprises a first end structure. The first end structure comprises a first upper end panel 114A hingedly connected to a first end of the main panel 112 by a hinged connection in the form of a fold line 113A. A first lower end panel 114B is hingedly connected to the first upper end panel 114A by a hinged connection in the form of a fold line 113B.

The first end structure comprises a first corner panel 160A hingedly connected to a first end of the first side panel 118 by a hinged connection in the form of a fold line 161A. A second corner panel 160B is hingedly connected to a first end of the second side panel 120 by a hinged connection in the form of a fold line 161B.

The first end structure comprises a first securing panel 164A hingedly connected to the first corner panel 160A by a hinged connection in the form of a fold line 163A. A second securing panel 164B is hingedly connected to the second corner panel 160B by a hinged connection in the form of a fold line 163B.

A first web panel 168A is hingedly connected at one end to the first securing panel 164A by a hinged connection in the form of a fold line 169A and is hingedly connected at a second end to the first upper end panel 114A by a hinged connection in the form of a fold line 171A.

A second web panel 168B is hingedly connected at one end to the second securing panel 164B by a hinged connection in the form of a fold line 169B and is hingedly connected at a second end to the first upper end panel 114A by a hinged connection in the form of a fold line 171B.

The blank 110 comprises a second end structure. The second end structure comprises a second upper end panel 116A hingedly connected to a second end of the main panel 112 by a hinged connection in the form of a fold line 115A. A second lower end panel 116B is hingedly connected to the second upper end panel 116A by a hinged connection in the form of a fold line 115B.

The second end structure comprises a third corner panel 162A hingedly connected to a second end of the first side panel 118 by a hinged connection in the form of a fold line 165A. A fourth corner panel 162B is hingedly connected to a second end of the second side panel 120 by a hinged connection in the form of a fold line 165B.

The first end structure comprises a third securing panel 166A hingedly connected to the third corner panel 162A by a hinged connection in the form of a fold line 167A. A fourth securing panel 166B is hingedly connected to the fourth corner panel 162B by a hinged connection in the form of a fold line 167B.

A third web panel 170A is hingedly connected at one end to the third securing panel 166A by a hinged connection in the form of a fold line 173A and is hingedly connected at a second end to the second upper end panel 116A by a hinged connection in the form of a fold line 175A.

A fourth web panel 170B is hingedly connected at one end to the fourth securing panel 166B by a hinged connection in the form of a fold line 173B and is hingedly connected at a second end to the second upper end panel 116A by a hinged connection in the form of a fold line 175B.

It will be appreciated that the first side panel 118, the first corner panel 160A, the first securing panel 164A, the third corner panel 162A, and the third securing panel 166A form a first strap 164A/160A/118/162A/166A along a first side of the main panel 112. The second side panel 120, the second corner panel 160B, the second securing panel 164B, the fourth corner panel 162B, and the fourth securing panel 166B form a second strap 164B/160B/120/162B/166B along a second side of the main panel 112.

The blank 110 comprises first flap 172 hingedly connected to the first lower end panel 1148 by a hinged connection. The hinged connection is defined, at least in part, by a cut line V1. Cut line V1 defines a tab P1 extending from an outer or lower edge of the first lower end panel 114B. The cut line V1 forms a receiver, in the form of an opening, slot or slit, for receiving a locking tab or detent C1. Each of the first and second securing panels 164A, 164B comprises a locking tab or detent C1 extending from a lower edge thereof.

The first flap 172 may comprise a pair of wing portions 174A, 174B hingedly connected by a respective fold line 177A, 177B to a central portion of the first flap 172. The fold lines 177A, 177B may be divergently arranged with respect to each other, the fold lines 177A, 1778 diverge towards the first lower end panel 1148.

Each of the first and second securing panels 164A, 1648 comprises a cutaway in the form of an aperture A5. Each aperture A5 forms a second receiver for receiving a respective second locking tab or detent C2. The first upper end panel 114A comprises a pair of cut lines 101, each of which is substantially "U" shaped, each cut line 101 defines a respective detent C2.

The blank 110 comprises second flap 176 hingedly connected to the second lower end panel 1168 by a hinged connection. The hinged connection is defined, at least in part, by a cut line V2. Cut line V2 defines a second tab P2 extending from an outer or lower edge of the second lower end panel 116B. The cut line V2 forms a receiver, in the form of an opening, slot or slit, for receiving a locking tab or detent C2. Each of the third and fourth securing panels 166A, 166B comprises a locking tab or detent C2 extending from a lower edge thereof.

The second flap 176 may comprise a pair of wing portions 178A, 178B hingedly connected by a respective fold line 178A, 178B to a central portion of the second flap 176. The fold lines 179A, 179B may be divergently arranged with respect to each other, the fold lines 179A, 179B diverge towards the second lower end panel 1168.

Each of the third and fourth securing panels 166A, 166B comprises a cutaway in the form of an aperture A5. Each aperture A5 forms a second receiver for receiving a respective second locking tab or detent C2. The second upper end panel 116A comprises a pair of cut lines 101, each of which is substantially "U" shaped, each cut line 101 defines a respective detent C2.

The main panel 112 comprises a plurality of article retention structures RT, specifically eight article retention structures RT arranged in 2×4 matrix or array. Each of the article retention structures RT comprise an opening or aperture A4.

The article retention structures RT each comprise a plurality of teeth or tabs 140 disposed about the aperture A4.

The plurality of teeth 140 are provided by the main panel 112. Each of the teeth 140 is hingedly connected to the main panel 112, by a hinged connection. The hinged connection may be defined by a plurality of cut lines 141. The plurality of cut lines 141 may be arranged as an annular series of cuts about the apertures A4.

The plurality of cut lines 141 may define or approximate a portion of circle.

Each of the plurality of teeth 140 comprises an engaging edge opposing a hinged edge. The engaging edges are defined by a linear portion of a cut line defining the aperture A4. Each engaging edge may define a part of a polygon. The illustrated embodiment comprises sixteen teeth 140 together defining a hexadecagon. Each tooth 140 comprises a pair of side edges, the side edges are defined by cut lines 143, 145 extending radially outward from respective vertices of the hexadecagon, that is to say, from a respective vertex between a pair of adjacent linear portions of the cut line defining the portion of a hexadecagon. The cut lines 143, 145 are divergently arranged with respect to each other and define an angle therebetween, the angle may be about 22.5°. Each of the plurality of cut lines 141 may be linear in shape.

The end structures are folded to secure the first and second side panels 118, 120 about sides of a group of articles B. In contrast to the embodiment of FIG. 1 in which the blank 10 is performed before application to a group of articles B, the blank 110 can be applied to the group of articles B in a flat form and folded thereabout.

The main panel 112 is lowered with respect to a group of articles B. The first and second side panels 118, 120 are folded about the opposing side of the group of articles B. The corner panels 160A, 160B, 162A, 162B are folded about the corners of the group of articles B and the securing panels 164A, 164B, 166A, 166B are folded about ends of the group of articles B.

Figure 7:
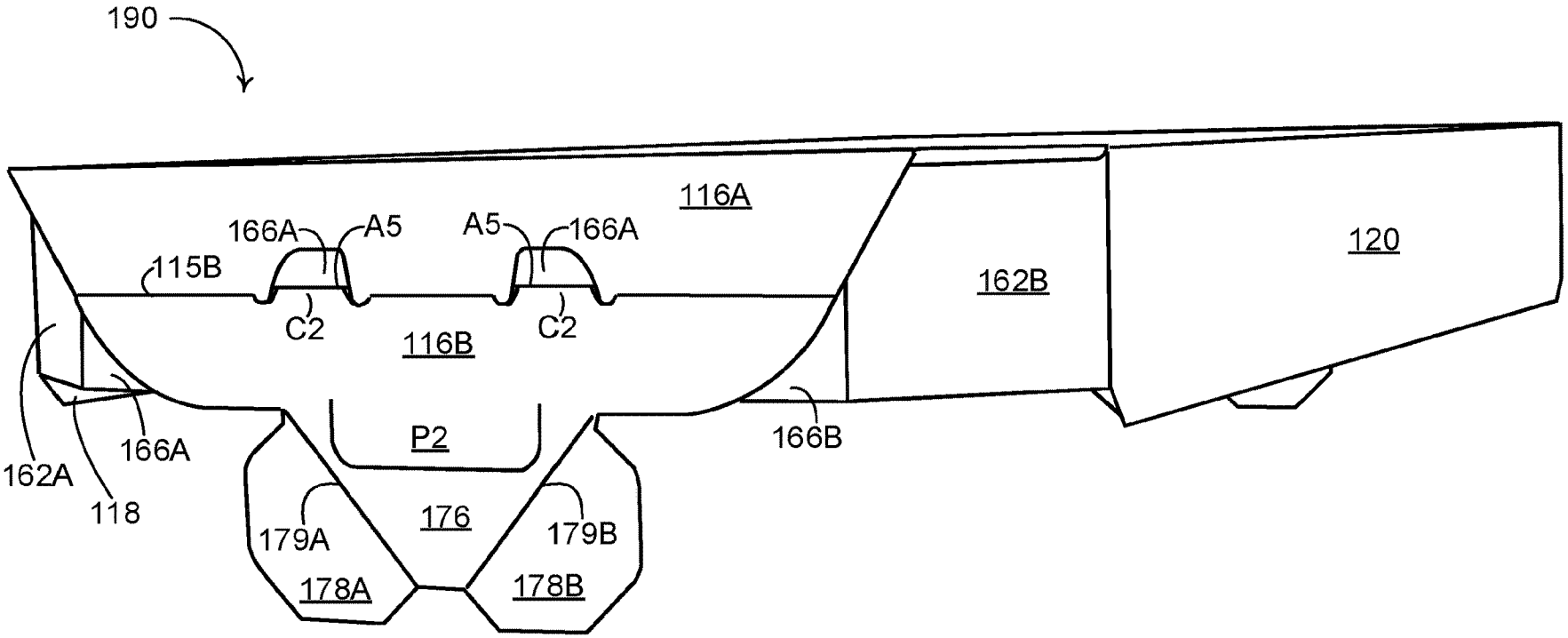
FIGS. 7 and 8 illustrate stages of construction of the carrier of FIG. 5.

The first and second upper end panels 114A, 116A are folded downwards about a respective end of the group of articles B. The first and second lower end panels 114B, 116B are folded upwardly with respect to the first and second upper end panels 114A, 116A such that the detents C2 can be inserted into the apertures A5. The first and second lower end panels 114B, 116B are folded downwardly to return to a substantially coplanar relationship with the respective one of the first and second upper end panels 114A, 116A to which they are hinged, as shown in FIG. 7 (the articles B have been omitted for illustrative purposes).

Figure 8:
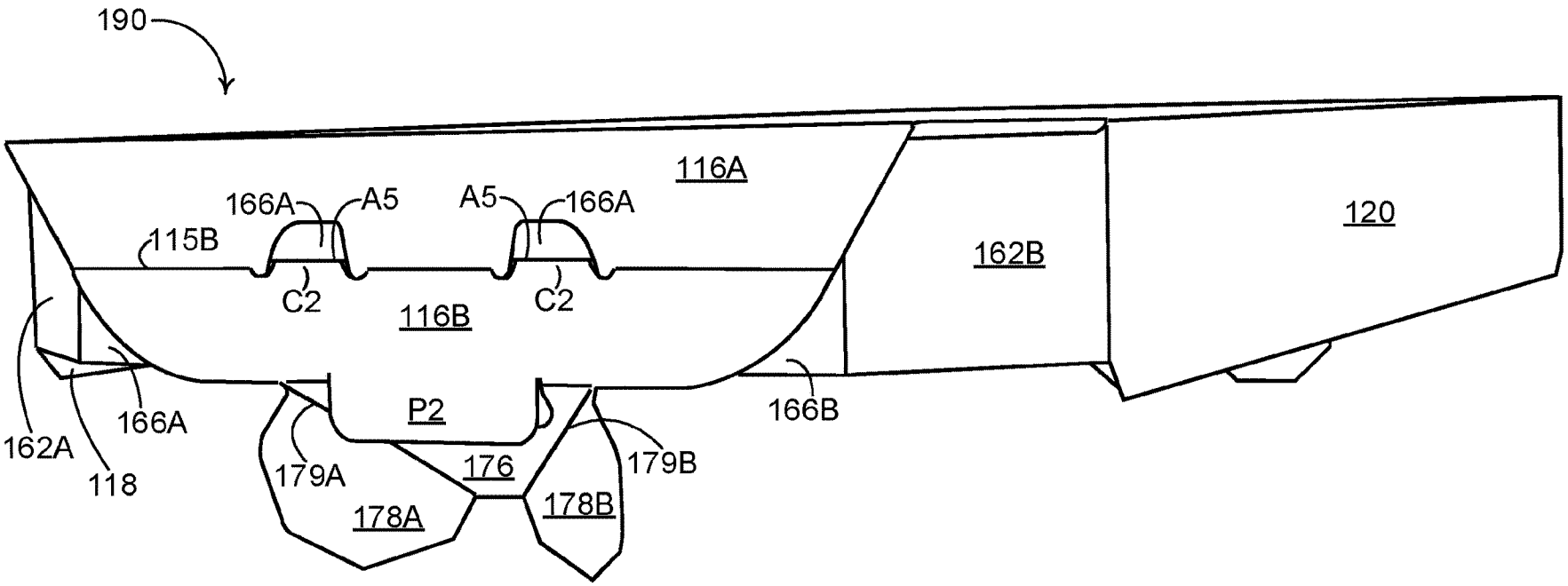

The first and second flap 172, 176 are folded internally, the wing portion 174A, 174B, 176A, 176B are folded with respect to the central portion so as to pass the side walls of adjacently disposed articles B, as shown in FIG. 8.

Figure 9:
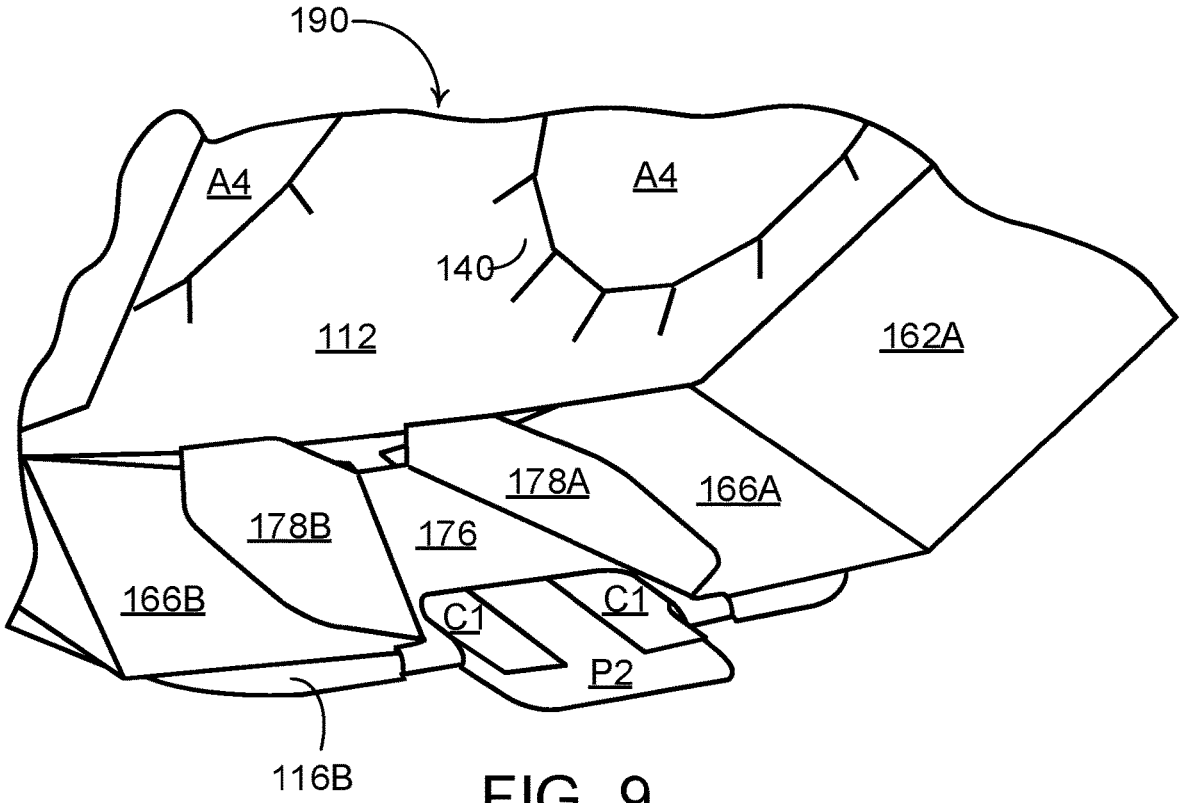
FIG. 9 is an internal view of a portion of the carrier of FIG. 6.

FIG. 9 illustrates an internal view of an end portion of the carton 190, the articles B have been omitted for illustrative purposes. The cut line V2 has formed an opening in which the locking tab C1 of each securing panel 166A, 166B is received.

The wing portion 178A, 178B are folded into coplanar relationship with the central portion of tab 172; in this way the tab 172 is held in position by the adjacently disposed articles (not shown).

The tab 172 is held in the folded condition by the articles B and inhibits disengagement of the locking tabs C1 from the receiver.

The tab 172 in the folded condition is in face to face relationship with the portions of the detents C2 received in the apertures A5; and may inhibit disengagement of detents C2 from the apertures A5.

The tabs P1, P2 may conceal or protect the locking tabs C1 so as to improve security of the locking tabs C1 in the receiver.

Referring now to FIG. 10 there is shown an alternative embodiment of the present disclosure. In the third illustrated embodiment, like numerals have, where possible, been used to denote like parts, albeit with the addition of the prefix "200" to indicate that these features belong to the second embodiment. The alternative embodiment shares many common features with the embodiment of FIGS. 1 to 9, therefore only the differences from the embodiment illustrated in FIGS. 1 to 9 will be described in any greater detail.

FIG. 10 shows a blank 210 comprising a plurality of panels 212, 214A, 214B, 216A, 216B, 218, 220, including a main panel 212 for forming a top wall or engaging panel of a carrier (not shown).

The main panel 212 comprises at least one article retention structure RT1, RT2. The main panel 212 comprises a plurality of article retention structures RT1, RT2, specifically eight article retention structures RT1, RT2 arranged in 2×4 matrix or array. Each of the article retention structures RT1, RT2 comprises an opening or aperture A7, A8.

The article retention structures RT1, RT2 of the illustrated embodiment take the form of a plurality of teeth or tabs 246, 244 arranged in an annular series about an aperture A7, A8 to form part of an article receiving opening.

The blank 210 comprises four first or endmost article retention structures RT1 each comprising a first opening or aperture A7. The blank 210 comprises four second, medial or intermediate article retention structures RT2 each comprising a second opening or aperture A8.

The endmost article retention structures RT1 comprises an article receiving opening defined in part by the first aperture A7 which is defined in, or struck from, the main panel 212.

The intermediate article retention structures RT2 comprises an article receiving opening defined in part by the second aperture A8 which is defined in, or struck from, the main panel 212.

The endmost article retention structures RT1 and the intermediate article retention structures RT2 each comprise a plurality of teeth or tabs 246, 244 disposed about the first or second aperture A7, A8 respectively.

The plurality of teeth 246, 244 are provided by the main panel 212. Each of the teeth 246, 244 is hingedly connected to the main panel 212, by a hinged connection. The hinged connection may be defined by a plurality of cut lines 41. The plurality of cut lines 242, 254 may be arranged as an annular series of cuts about the first or second apertures A1, A2. The plurality of cut lines 242, 254 may define or approximate a portion of circle.

Each of the first article retention structures RT1 is substantially similar in construction and will therefore be described in detail with reference to a first one of the first article retention structures RT1 located adjacent to a first end of the blank 210 as shown in FIG. 10.

The first article retention structure RT1 comprises a plurality of first or full teeth 246 disposed about the aperture A1. Each of the plurality of first teeth 246 comprises an engaging edge E1 opposing a hinged edge. The engaging edges E1 are defined by a linear portion of a cut line defining the aperture A7. Each engaging edge E1 defines a part of a hexadecagon. The illustrated embodiment comprises eight first teeth 246 together defining a portion of a hexadecagon. Each tooth 246 comprises a pair of side edges, the side edges are defined by cut lines 247, 248 extending radially outward from respective vertices of the hexadecagon. That is to say from a respective vertex between a pair of adjacent linear portions of the cut line defining the aperture A7. The cut lines 247, 248 are divergently arranged with respect to each other and define an angle therebetween, the angle may be about 22.5°.

The first article retention structure RT1 comprises a plurality of first circumferential cut lines 254. Each of the plurality of first circumferential cut lines 254 is aligned with one of the radial cut lines 247, 248 such that said one of the radial cut lines 247, 248 or a notional extension thereof bisects a respective one of the plurality of first circumferential cut lines 254.

Each of the plurality of first circumferential cut lines 254 is spaced apart from said one of the radial cut lines 247, 248 bisecting it so as to define a connecting nick or bridge portion between a pair of adjacently disposed teeth 246, 244.

Each of the plurality of first circumferential cut lines 254 may be linear in shape.

The first article retention structure RT1 comprises a plurality of second circumferential cut lines 242. Each of the plurality of second circumferential cut lines 242 is disposed between a pair of the plurality of first circumferential cut lines 254 and is spaced apart therefrom so as to define a pair of connecting nick or bridge portions between each tooth 246, 244 and the main panel 212. The pair of connecting nick or bridge portions provide a hinged or foldable connection between each tooth 246, 244 and the main panel 212.

Each of the plurality of second circumferential cut lines 142 may be linear in shape.

In alternative embodiments each of the plurality of first circumferential cut lines 254 may be arcuate or curved. The first circumferential cut lines 254 may comprise a radius of curvature which is equal to half the diameter of the article receiving openings. The first circumferential cut lines 254 may comprise a radius of curvature which is greater than half the diameter of the apertures A7.

In alternative embodiments each of the plurality of second circumferential cut lines 242 may be arcuate or curved. The second circumferential cut lines 242 may comprise a radius of curvature which is equal to half the diameter of the article receiving openings. The second circumferential cut lines 242 may comprise a radius of curvature which is greater than half the diameter of the aperture A7.

The first and second circumferential cut lines 242, 254 when linear may be considered to define portions of a circle of infinite radius.

In the illustrated embodiment, the radius of curvature of each of the plurality of second circumferential cut lines 242 is equal to the radius of curvature of each of the plurality of first circumferential cut lines 254 however in other embodiments it may be different.

Optionally, the plurality of teeth 246, 244 is interrupted by a first recess or cutaway 256B. The first recess 256B lies upon a first notional line y-y. First notional line y-y extends radially from the centre C of the apertures A7, A8 and passes through the centre of the first recess 256B. The first notional line y-y may extend across the grain of the blank 210. The first notional line y-y is oriented perpendicularly with respect to the grain direction. The first notional line y-y extends longitudinally of the blank 210.

Optionally, the plurality of teeth 246, 244 is interrupted by a second recess or cutaway 256C. The second recess 256C lies upon a second notional line x-x. Second notional line x-x extends radially from the centre C of the apertures A7, A8 and passes through the centre of the second recess 256C. The second notional line x-x may extend along the grain of the blank 210. The notional line x-x is oriented parallel with respect to the grain direction. The notional line x-x extends transversely, or laterally, of the blank 210.

The first recess 256B is dimensioned so as to occupy a first arc defined by a first minor sector. The first minor sector is defined in part by a first sector notional line extending radially from the centre C of the notional circle and passing through a side edge of a first partial tooth 244 disposed adjacent a first side of the first recess 256B and in part by a second sector notional line extending radially from the centre C of the notional circle and passing through a side edge of a second partial tooth 244 disposed adjacent a second, opposing, side of the first recess 256B. The first and second sector notional lines define a second angle therebetween. The second angle may be in the range 35° to 50°, and may be around 45°.

The second recess 256C is dimensioned so as to occupy a second arc defined by a second minor sector. The second minor sector is defined in part by a third sector notional line extending radially from the centre C of the notional circle and passing through a side edge of a third partial tooth 244 disposed adjacent a first side of the second recess 256C and in part by a fourth sector notional line extending radially from the centre C of the notional circle and passing through a side edge of a fourth partial tooth 144 disposed adjacent a second, opposing, side of the second recess 256C. The third and fourth sector notional lines define a third angle therebetween. The third angle may be in the range 35° to 50°, and may be around 45°.

The first and third sector notional lines define a major or first toothed sector, the first toothed sector defines a third arc; the third arc is occupied by teeth 246, 244. That is to say teeth 246, 244 are disposed about the third arc, in a perimeter region of the first aperture A7.

The second and fourth sector notional lines define a third minor sector or second toothed sector, the second toothed sector defines a fourth arc; the fourth arc is occupied by teeth 246, 244. That is to say teeth 246, 244 are disposed about the fourth arc, in a perimeter region of the first aperture A7.

The first article retention structure RT1 comprises a first engaging tab T1 opposing the second recess 256C and a second engaging tab T2 opposing the first recess 256B.

The first engaging tab T1 is disposed proximate the first or second side panel 218, 220. The second engaging tab T2 is disposed proximate the first or second upper end panel 214A, 216A. The first engaging tab T1 is integral with the main panel 212, that is to say the first and second circumferential cut lines 242, 254 have been omitted. The first engaging tab T1 is proximate to the fold line 217, 219 hinging the main panel to the respective side panel 218, 220.

The second engaging tab T2 is integral with the main panel 212, that is to say the first and second circumferential cut lines 242, 254 have been omitted. The second engaging tab T2 is proximate to the fold line 213A, 215A hinging the main panel to the respective upper end panel 214A, 216A.

Each of the second article retention structures RT2 is substantially similar in construction and will therefore be described in detail with reference to a first one of the second article retention structures RT2 located adjacent to the first one of the first article retention structures RT1 as shown in FIG. 10.

The second article retention structure RT2 comprises an article receiving opening defined in part by a second aperture A8.

The second article retention structure RT2 comprises a plurality of teeth 246, 244 disposed about the second aperture A8. The plurality of teeth 246, 244, or at least free edges thereof, may define or approximate a second notional circle.

The plurality of teeth 246, 244 are hinged to the main panel 212 by a fold line. The fold line may be defined by a plurality of cut lines 242, 254. The plurality of cut lines 242, 254 may define or approximate a circle.

The second aperture A8 comprises a plurality of first or full teeth 246 disposed about the second aperture A8. Each of the plurality of first teeth 246 comprises an engaging edge E1 opposing a hinged edge. The engaging edges E1 are defined by a linear portion of a cut line defining the second aperture A8. Each engaging edge E1 defines a part or side of a hexadecagon. The illustrated embodiment comprises seven first teeth 246 together defining a portion of a hexadecagon. Each tooth 246 comprises a pair of side edges, the side edges are defined by cut lines 247, 248 extending radially outward from respective vertices of the hexadecagon. That is to say from a respective vertex between a pair of adjacent linear portions of the cut line defining the second aperture A8. The cut lines 247, 248 are divergently arranged with respect to each other and define an angle therebetween, the angle may be about 22.5°.

The second article retention structure RT2 comprises a plurality of first circumferential cut lines 254. Each of the plurality of first circumferential cut lines 254 is aligned with one of the radial cut lines 247, 248 such that said one of the radial cut lines 247, 248, or a notional extension thereof, bisects a respective one of the plurality of first circumferential cut lines 254.

Each of the plurality of first circumferential cut lines 254 is spaced apart from said one of the radial cut lines 247, 248 bisecting it so as to define a connecting nick or bridge portion between a pair of adjacently disposed teeth 246, 244. The connecting nick or bridge portion is disposed proximate a base of the teeth 246.

Each of the plurality of first circumferential cut lines 254 may be linear in shape.

The second article retention structure RT2 comprises a plurality of second circumferential cut lines 242. Each of the plurality of second circumferential cut lines 242 is disposed between a pair of the plurality of first circumferential cut lines 254 and is spaced apart therefrom so as to define a pair of connecting nick or bridge portions between each tooth 246, 244 and the main panel 212. The pair of connecting nick or bridge portions provide a hinged or foldable connection between each tooth 246, 244 and the main panel 212.

Each of the plurality of second circumferential cut lines 242 may be linear in shape.

The plurality of teeth 246, 244 is interrupted by a first recess or cutaway 256B, by a second recess or cutaway 256C and by a third recess or cutaway 256A. The first and third recesses 256B, 256A each lie upon the first notional line y-y. The first notional line y-y extends radially from the centre C of the second aperture A8 and passes through the centre of each of the first and third recesses 256B, 256A.

The first recess 256B is dimensioned so as to occupy a first arc defined by a first minor sector. The first minor sector is defined in part by a first sector notional line extending radially from the centre C of the notional circle and passing through a side edge of a first partial tooth 244, disposed adjacent to a first side of the first recess 256B, and in part by a second sector notional line extending radially from the centre of the notional circle and passing through a side edge of a second partial tooth 244, disposed adjacent to a second, opposing, side of the first recess 256B. The first and second sector notional lines define an angle therebetween. The angle may be in the range 35° to 50°, and may be around 45°.

The second recess 256C is dimensioned so as to occupy a second arc defined by a second minor sector. The second minor sector is defined in part by a third sector notional line extending radially from the centre C of the notional circle and passing through a side edge of a third partial tooth 244, disposed adjacent to a first side of the second recess 256C, and in part by a fourth sector notional line extending radially from the centre C of the notional circle and passing through a side edge of a fourth partial tooth 244, disposed adjacent to a second, opposing, side of the second recess 256C. The third and fourth sector notional lines define an angle therebetween. The third angle may be in the range 35° to 50°, and may be around 45°.

The third recess 256A is dimensioned so as to occupy a third arc defined by a third minor sector. The third minor sector is defined in part by a fifth sector notional line extending radially from the centre C of the notional circle and passing through a side edge of a fifth partial tooth 244, disposed adjacent to a first side of the third recess 256A, and in part by a sixth sector notional line extending radially from the centre C of the notional circle and passing through a side edge of a sixth partial tooth 144, disposed adjacent to a second, opposing, side of the third recess 256A. The fifth and sixth sector notional lines define an angle therebetween. The third angle may be in the range 35° to 50°, and may be around 45°.

The first and fifth sector notional lines define a major or first toothed sector, the first toothed sector defines a fourth arc; the fourth arc is occupied by teeth 246, 244. That is to say teeth 246, 244 are disposed about the fourth arc, in a perimeter region of the second aperture A8.

The second and fourth sector notional lines define a third minor sector or second toothed sector, the second toothed sector defines a fifth arc; the fifth arc is occupied by teeth 246, 244. That is to say teeth 246, 244 are disposed about the fifth arc, in a perimeter region of the second aperture A8.

The third and sixth sector notional lines define a fourth minor sector or third toothed sector, the third toothed sector defines a sixth arc; the sixth arc is occupied by teeth 246, 244. That is to say teeth 246, 244 are disposed about the sixth arc, in a perimeter region of the second aperture A8.

The first and third recesses 256B, 256A are diametrically opposed to each other.

The second recess 256C is oriented or disposed substantially orthogonally to the first and third recesses 256B, 256A.

The centre of the first and third recesses 256B, 256A of the second article retention structure RT2 are collinear with the centre of the first recess 256B of the first article retention structure RT1.

The first recess 256B of the second article retention structure RT2 is disposed proximate to the first recess 256B of the first article retention structure RT1 and is oriented in opposition thereto.

Each of the second recesses 256C of the second article retention structures RT2 is disposed proximate to a second recess of an adjacently disposed second article retention structures RT2, and is oriented in opposition thereto.

Each of the second recesses 256C of the first article retention structures RT1 is disposed proximate to a second recess 256C of an adjacently disposed first article retention structures RT1, and is oriented in opposition thereto.

The second article retention structure RT2 comprises a first engaging tab T1 opposing the second recess 256C.

The first engaging tab T1 is disposed proximate the first or second side panel 218, 220. The first engaging tab T1 is integral with the main panel 212, that is to say the first and second circumferential cut lines 242, 254 have been omitted. The first engaging tab T1 is proximate to the fold line 217, 219 hinging the main panel to the respective side panel 218, 220.

The grain of the material forming the blank 210 may be arranged to be tangential to the centre of the first and third recesses 256B, 256A of the second article retention structure RT2. The grain of the material forming the blank 210 may be arranged to be tangential to the centre of the first recess 256B of the first article retention structure RT1. In this way in order for a tear to propagate between the first aperture A7 and the second aperture A8 the tear must propagate across the grain of the blank 210. In this way the blank 210 is arranged to provide maximum resistance to tear propagation between the first and second apertures A7, A8.

Removal of the teeth 246, by providing recesses 256B, 256C, 256A at locations where two adjacent apertures A7, A8 are disposed in close proximity, for example when packaging articles B of the sleek or slim design (articles B which are substantially of the same diameter over their entire height. In some embodiments the variation in diameter between a top closure of the article Band the main body of the article B may be less than 7 mm, may be less than 5 mm and optionally is less than 4 mm.), has been found to reduce the likelihood of tear propagation. This beneficial advantage may be a result of removal of the radial cut lines 247, 248 in regions of the blank 210 where the apertures A7, A8 are in close proximity.

The blanks 10; 110; 210 include at least a paperboard substrate. The material of the paperboard substrate may be selected from any conventional paperboard, for example, ranging in weight upwardly from about 10pt., preferably from about 16pt. to about 28pt. (0.028"1~0.7 mm). An example of such a substrate is a 27 point (pt.) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier of the top engaging type having improved article retention structures or article top engaging devices.

An article carrier 90; 190 for clipping or engaging on at least one article B. The article carrier 90; 190 comprises an engaging panel 12; 112; 212 which has at least one article-engaging structure RT; RT1, RT2 for engaging a part of the at least one article B. The article carrier 90; 190 comprises a bundling, grouping or support structure for encircling the at least one article B. The bundling structure comprises a first segment and a second segment. In some embodiments the article carrier 90; 190 may be a preformed article carrier 90 assembled or constructed prior to application to a group of articles B.

The first segment includes a first panel 14; 118; 218 hingedly connected to the engaging panel 12; 112; 212 and a bridging portion 22A, 26A; 160A; 164A; 260A; 264A hingedly connected to the first panel 14; 118; 218.

The second segment includes a second panel 18A; 114A/114B; 214A/214B hingedly connected to the engaging panel 12, 12; 112; 212 a third panel 18B; 172; 272 hingedly connected to the second panel 18A; 114A/114B; 214A/214B and disposed in an overlapping position with the second panel 18A; 114A/114B; 214A/214B and a bridge-engaging feature in engagement with the bridging portion 22A, 26A; 160A; 164A; 260A; 264A of the first segment.

The bridging portion 22A, 26A; 160A; 164A; 260A; 264A may comprise a catch or detent for arresting or inhibiting relative movement between the bridging portion 22A, 26A; 160A; 164A; 260A; 264A and the second and third panels 18A, 18B; 114A/114B, 172; 214A/214B, 272.

The bridge-engaging feature is provided at least by the second and third panels 18A, 18B; 114A/114B, 172; 214A/214B, 272 such that at least part of the bridging portion 22A, 26A; 160A; 164A; 260A; 264A is disposed between the second and third panels 18A, 18B; 114A/114B, 172; 214A/214B, 272 in face-contacting arrangement with the second and third panels 18A, 18B; 114A/114B, 172; 214A/214B, 272. The bridge-engaging feature may comprise a first cutaway defined in at least one of the second and third panels 18A, 18B; 114A/114B, 172; 214A/214B, 272 the first cutaway providing a first receiver for a first portion of the bridging portion 22A, 26A; 160A; 164A; 260A; 264A.

The bridge-engaging feature may further comprise a second cutaway in at least one of the engaging panel 12 and second panel 18A, the second cutaway providing a second receiver for a second portion of the bridging portion 22A, 26A. The second cutaway may extend from or interrupt at least one article-engaging structure RT1, RT2.

The bridge-engaging feature may further comprise a second cutaway in one of the bridging portion 160A; 164A; 260A; 264A and second panel 114A/114B; 214A/214B, the second cutaway providing a second receiver for a tab C1 provided by the other one of the bridging portion 160A; 164A; 260A; 264A and second panel 114A/114B; 214A/214B.

The present disclosure also provides an article carrier 90 comprising an engaging panel 12 which has at least one article-engaging structure RT1, RT2 for engaging a part of the at least one article B and a bundling structure for encircling the at least one article B. The bundling structure comprises a first segment, a second segment, and a bridge-engaging feature. The first segment includes a first panel 14, 16 hingedly connected to the engaging panel 12 and a bridging portion 22A/26A, 22B/26B, 24A/28A, 24B/28B hingedly connected to the first panel 14, 16. The second segment includes a second panel 18A hingedly connected to the engaging panel 12. The bridge-engaging feature is provided by at least part R1 of the at least one article-engaging structure RT1. The bridge-engaging feature is engageable, or in engagement, with the bridging portion 22A/26A, 22B/26B, 24A/28A, 24B/28B of the first segment such that the first panel 14, 16 and second panel 18A are interconnected continuously by the bridging portion 22A/26A, 22B/26B, 24A/28A, 24B/28B extending between the first and second segments.

The bridge-engaging feature may comprise at least one locking element provided by the second panel and at least one locking opening defined in the bridging portion and receiving the locking element.

A fugitive glue may be employed to secure the end, side or corner panels to the articles B. Use of a fugitive glue is optional, an advantage of a fugitive glue is its tendency to remain attached to the carrier when the articles are disengaged from the carrier (this may be more desirable than having the glue remain attached to the articles). In alternative embodiments other adhesives maybe employed such as, but not limited to, hot-melt glue. The end panels 14, 16 may be adhered to at least one article B. The inner side panels 18B, 20B may be adhered to at least one article B.

The carrier may comprise a handle opening defined, at least in part, in one of the panels forming the first or second segment. The handle opening may be defined in part in the engaging panel.

The carrier may comprise a handle opening defined, at least in part, in the engaging panel.

The carrier 90 may comprise a side panel 18A/18B, 20A/20B of a two-ply structure comprising an inner side panel 18B, 20B and an outer side panel 18A, 20A in face to face relationship therewith. The inner side panel 18B, 20B may be hingedly connected to the outer side panel 18A, 20A.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for engaging at least one article, the article carrier comprising an engaging panel which has at least one article-engaging structure for engaging a part of the at least one article, wherein the article carrier further comprises a bundling structure for at least partially encircling the at least one article, the bundling structure comprises a first segment and a second segment, the first segment comprises:

a first panel hingedly connected to the engaging panel; and a bridging portion hingedly connected to the first panel, wherein the second segment comprises:

a second panel hingedly connected to the engaging panel;

a third panel hingedly connected to the second panel and disposed in an at least partially overlapping position with the second panel; and a bridge-engaging feature in engagement with the bridging portion of the first segment, wherein the bridge-engaging feature is provided at least by one of the second and third panels such that at least part of the bridging portion is disposed between the second and third panels in face-contacting arrangement with the second and third panels.

2. An article carrier, according to claim 1, wherein the bridge-engaging feature comprises a first cutaway defined in at least one of the second and third panels, the first cutaway providing a first receiver for a first portion of the bridging portion.

3. An article carrier, according to claim 1, wherein the bridge-engaging feature comprises a second cutaway in at least one of the engaging panel and the second panel, the second cutaway being engageable with a second portion of the bridging portion.

4. An article carrier, according to claim 3, wherein the second cutaway extends from one of said at least one article-engaging structures.

5. An article carrier, according to claim 1, wherein the bridging portion comprises at least one detent or locking tab.

6. An article carrier, according to claim 1, wherein the bridge-engaging feature comprises at least one locking element provided by the second panel and at least one locking opening defined in the bridging portion and receiving the locking element.

7. An article carrier, according to claim 1, wherein the bridge-engaging feature comprises a second cutaway in one of the bridging portion and the second panel, the second cutaway providing a second receiver for a tab provided by the other one of the bridging portion and the second panel.

8. An article carrier, according to claim 1, comprising a handle opening defined, at least in part, in the engaging panel.

9. An article carrier for engaging at least one article, the article carrier comprising an engaging panel which has at least one article-engaging structure for engaging a part of the at least one article and a bundling structure for at least partially encircling the at least one article, the bundling structure comprising a first segment, a second segment, and a bridge-engaging feature, wherein the first segment comprises:

a first panel hingedly connected to the engaging panel; and a bridging portion hingedly connected to the first panel; wherein the second segment comprises:

a second panel hingedly connected to the engaging panel;

wherein the bridge-engaging feature is provided by at least part of the at least one article-engaging structure, the bridge-engaging feature being engaged with the bridging portion of the first segment such that the first panel and the second panel are interconnected continuously by the bridging portion extending between the first panel and the second panel.

10. An article carrier, according to claim 9, comprising a handle opening defined, at least in part, in one of the first panel and the second panel.

11. An article carrier, according to claim 10, wherein the handle opening is defined in part in the engaging panel.

12. A blank for forming an article carrier, the blank comprising:

an engaging panel which has at least one article-engaging structure for engaging a part of at least one article to be carried by the article carrier; and a bundling structure for at least partially encircling the at least one article, the bundling structure comprising a first segment, a second segment, and a bridge-engaging feature, wherein the first segment comprises:

a first panel hingedly connected to the engaging panel; and a bridging portion hingedly connected to the first panel;

wherein the second segment comprises:

a second panel hingedly connected to the engaging panel;

wherein the bridge-engaging feature is provided at least in part by the second segment, the bridge-engaging feature being engageable with the bridging portion of the first segment in a setup carrier such that the first panel and second panel are interconnected continuously by the bridging portion extending between the first segment and the second segment.

13. A blank according to claim 12, wherein the second segment further comprises:

a third panel hingedly connected to the second panel and disposed in an at least partially overlapping position with the second panel;

wherein the bridge-engaging feature is provided at least by the second and third panels and arranged such that in a setup carrier at least part of the bridging portion is disposed between the second and third panels in face-contacting arrangement with the second and third panels.

14. A blank according to claim 13, wherein the bridge-engaging feature comprises a cutaway defined in at least one of: (i) the engaging panel and (ii) at least one of the second and third panels, the cutaway providing a receiver for a tab of the bridging portion.

15. A blank according to claim 14, wherein each of the at least one article-engaging structure comprises an aperture formed in the engaging panel, and wherein the cutaway extends from the aperture.

16. A blank according to claim 12, wherein the bridging portion comprises at least one detent or locking tab configured to engage with the bridge-engaging feature.

17. A blank according to claim 12, further comprising a handle opening defined, at least in part, in the engaging panel.

18. A blank according to claim 12, wherein the bridge-engaging feature is provided by at least part of the at least one article-engaging structure.

19. A blank according to claim 12, wherein the bridge-engaging feature comprises:

at least one locking element provided by the second segment; and at least one locking opening defined in the bridging portion and configured to receive the locking element such that the second segment is held in engagement with the bridging portion in the setup carrier.

20. A blank according to claim 12, wherein the bridge-engaging feature comprises a cutaway defined in one of the bridging portion and the second segment, the cutaway providing a receiver for a tab provided by the other one of the bridging portion and the second segment.

* * * * *